US006920387B2

(12) United States Patent
Landes et al.

(10) Patent No.: US 6,920,387 B2
(45) Date of Patent: Jul. 19, 2005

(54) METHOD AND APPARATUS FOR PARASITIC LOAD COMPENSATION

(75) Inventors: James W. Landes, East Peoria, IL (US); Mark E. Rettig, Decatur, IL (US)

(73) Assignee: Caterpillar Inc, Peoria, IL (US)

( * ) Notice: Subject to any disclaimer, the term of this patent is extended or adjusted under 35 U.S.C. 154(b) by 269 days.

(21) Appl. No.: 10/016,180

(22) Filed: Dec. 6, 2001

(65) Prior Publication Data

US 2003/0109977 A1 Jun. 12, 2003

(51) Int. Cl.[7] ..... G06G 7/70

(52) U.S. Cl. ..... 701/102; 701/101; 701/114; 701/115; 701/54; 701/59; 123/339.19; 123/464; 123/480; 123/492

(58) Field of Search ..... 701/102, 101, 701/114, 115, 59, 54; 123/339.19, 480, 464, 492

(56) References Cited

U.S. PATENT DOCUMENTS

| | | | | |
|---|---|---|---|---|
| 4,319,327 | A | 3/1982 | Higashiyama et al. | 364/431.05 |
| 4,368,705 | A | 1/1983 | Stevenson et al. | |
| 4,658,943 | A | 4/1987 | Nishikawa et al. | |
| 4,823,555 | A | 4/1989 | Ohkumo | |
| 4,829,440 | A | 5/1989 | Abe | 364/431.06 |
| 5,019,986 | A | 5/1991 | Londt et al. | |
| 5,091,858 | A | 2/1992 | Paielli | 364/431.12 |
| 5,123,239 | A | 6/1992 | Rodgers | |
| 5,126,943 | A | 6/1992 | Nakaniwa | 364/431.05 |
| 5,189,621 | A | 2/1993 | Onari et al. | |
| 5,233,889 | A | 8/1993 | Iizuka | |
| 5,257,193 | A | 10/1993 | Kusaka et al. | |
| 5,323,318 | A | 6/1994 | Hasegawa et al. | |
| 5,343,780 | A | 9/1994 | McDaniel et al. | |
| 5,394,327 | A | 2/1995 | Simon, Jr. et al. | 364/424.01 |
| 5,445,906 | A | 8/1995 | Hobson et al. | 429/162 |
| 5,455,767 | A | 10/1995 | Staerker | |
| 5,457,633 | A | 10/1995 | Palmer et al. | |
| 5,484,351 | A | 1/1996 | Zhang et al. | |
| 5,508,923 | A | 4/1996 | Ibamoto et al. | |
| 5,508,943 | A | 4/1996 | Batson et al. | |
| 5,586,538 | A | 12/1996 | Barnes | |
| 5,612,873 | A | 3/1997 | Ogawa | |
| 5,623,906 | A | 4/1997 | Storhok | |
| 5,797,110 | A | 8/1998 | Braun et al. | |
| 5,884,210 | A | 3/1999 | Rettig et al. | |
| 5,938,716 | A | 8/1999 | Shutty et al. | 701/115 |
| 5,979,402 | A | 11/1999 | Melbourne | 123/339.16 |
| 6,016,459 | A | 1/2000 | Isaac et al. | |
| 6,056,446 | A | 5/2000 | Welter et al. | |
| 6,076,036 | A | 6/2000 | Price et al. | |
| 6,094,617 | A | 7/2000 | Lapke | 701/104 |

(Continued)

*Primary Examiner*—Tony M. Argenbright
*Assistant Examiner*—Johnny Hoang
(74) *Attorney, Agent, or Firm*—Michael L Woods

(57) ABSTRACT

A control system for determining the net power output of an engine associated with a work machine or other vehicle wherein parasitic loads encountered during engine operation are taken into account, the control system including an electronic controller coupled to the engine, at least one sensor coupled to the controller for inputting at least one signal representative of certain operating parameters associated with the engine, and at least one other sensor coupled to the controller for inputting at least one signal representative of the operation of any parasitic load encountered during engine operation, the controller being operable to determine the total output power of the engine and the power requirements associated with any parasitic load based upon the sensor signals. The controller is also operable to output a signal representative of the difference between the total output power of the engine and the power requirements associated with any parasitic loads encountered during engine operation, the outputted signal being used for controlling the operation of the engine or other peripheral equipment or systems associated with the work machine or other vehicle.

39 Claims, 5 Drawing Sheets

U.S. PATENT DOCUMENTS 6,135,918 A 10/2000 Bellinger et al.
6,173,227 B1 1/2001 Speicher et al.
6,173,696 B1 1/2001 Fett et al.
6,199,006 B1 3/2001 Weiss et al.
6,208,925 B1 3/2001 Creger et al.
6,226,585 B1 5/2001 Cullen
6,328,014 B1 * 12/2001 Bradshaw ..... 123/300
6,580,977 B2 6/2003 Ding et al.
2002/0010534 A1 1/2002 Goodnight et al.
2003/0079720 A1 5/2003 McCauley et al.

* cited by examiner

METHOD AND APPARATUS FOR PARASITIC LOAD COMPENSATION

TECHNICAL FIELD

This invention relates generally to systems for monitoring and determining the power output of an engine and, more particularly, to a method and apparatus for more accurately determining the net power output of an engine associated with a work machine or other vehicle by automatically compensating for any parasitic loads encountered during engine operation.

BACKGROUND

Engines associated with work machines such as earthmoving and excavating equipment as well as over the road and off-road vehicles not only provide motive force for the particular work machine or other vehicle but such engines also power peripheral devices such as hydraulic pumps, cooling fans, compressors, air conditioners, generators (alternators) and other parasitic load components. Depending upon the particular work machine or other vehicle, the engine may be operated at a substantially constant speed or at variable speeds where instantaneous changes in output power are needed. In a similar fashion, some parasitic loads may require a substantially constant power input such as a cooling fan operating at a particular fan speed regardless of engine speed, whereas other parasitic loads may require a variable power input under certain operating conditions, even at the same engine speed, such as a hydraulic pump providing power to various hydraulic components during a digging or trenching operation.

Control systems for controlling the operation of an engine are also known and are commonly used on work machines and other vehicles. By sensing various operating parameters such as engine speed, throttle/fuel injection position, manifold pressure, various temperatures and other engine operating parameters, appropriate output signals can be made to various systems so as to operate the engine more efficiently and optimally depending upon the particular work task being performed. Since an engine controller typically monitors the power generated by the engine and the amount of power being required by various operating components of the work machine or other vehicle, and since this information is typically broadcasted or outputted by the engine controller for use by other systems in optimally controlling a particular work task being performed, it is important that the engine controller accurately broadcast the net power output of the engine including taking into account the power necessary to operate parasitic loads. Since the engine controller does not typically know the nature and level of the parasitic loads being imposed upon the engine during a particular work task, the net power output of the engine broadcasted by the engine controller is deficient; it does not compensate for all parasitic load operation; and it does not yield an accurate determination of the amount of power that the engine must generate at any particular point in time. This inaccuracy is exaggerated with respect to work machines such as large earthmoving and excavating equipment, track type tractors and a wide variety of other types of heavy duty equipment wherein large amounts of power are required to drive certain types of parasitic loads.

Accurately determining the net power output of a particular engine is likewise complicated due to the fact that many manufacturers purchase the basic engine separate and apart from the various parasitic load components which will be added later to the completed work machine or other vehicle. Once the engine, vehicle chassis and all related accessories and components are assembled, the engine is mated with a particular vehicle chassis and all of the accessory drives and other parasitic load components including the transmission and associated drive train are linked and coupled thereto. Since the engine manufacturers do not know what type of parasitic loads will be associated with a particular engine and, as a result, do not know the particular power requirements associated with such parasitic loads, they cannot program the associated engine controller to compensate for the wide variety of different power requirements associated with the operation of a wide variety of different parasitic loads when determining the net power output of the engine. This mating of the engine with the vehicle chassis and its associated parasitic load components exemplifies the difficulty in accurately compensating for the power requirements associated with any parasitic load encountered during a particular work task.

It is therefore desirable to provide a method and apparatus for more accurately determining the net power output of an engine available for performing a particular work task taking into account and compensating for all parasitic loads encountered during completion of such task. It is also desirable to provide a method and apparatus that will provide real time information indicative of available engine power to ensure that the available net power output of the engine is adequate to accomplish a particular task such as control operation of the engine and/or peripheral devices associated therewith.

Accordingly, the present invention is directed to overcoming one or more of the problems as set forth above.

SUMMARY OF THE INVENTION

In one aspect of the present invention, a control system is disclosed for determining the net power output of an engine associated with a work machine or other vehicle wherein the work machine or other vehicle includes an engine operable to provide power to at least two power-operated components, at least one of the power-operated components being a parasitic load component. The present control system includes an electronic controller coupled to the engine, at least one sensor coupled to the controller for inputting at least one signal representative of certain operating conditions of the engine, and at least one other sensor coupled to the controller for inputting at least one signal representative of the operation of the at least one parasitic load component. Stored within the memory of the controller is data relating to the power requirements of the at least one parasitic load component when that component is in operation at a plurality of different engine operating conditions or engine speeds. The controller is operable to determine the total output power of the engine based upon at least one of the sensor input signals; it is operable to determine the power requirements of the at least one parasitic load component based upon at least one of the sensor input signals; and it is operable to provide an output signal representative of the difference between the total output power of the engine and the power requirements associated with the at least one parasitic load component. This output signal can be used to control various operations of the work machine or other vehicle.

In another aspect of the present invention, a method is disclosed for determining the net power output of an engine associated with a work machine or other vehicle wherein the work machine or other vehicle includes an engine operable to provide power to at least two power-operated components, at least one of the power-operated components being a parasitic load component. The present method includes coupling an electronic controller to the engine, sensing at least one engine parameter representative of the operating condition of the engine, determining the total output power of the engine based upon the at least one sensed engine parameter, sensing whether the at least one parasitic load component is in operation during operation of the engine, and determining the power requirement associated with the operation of the at least one parasitic load component. Based upon the power requirements associated with the parasitic load components in operation, the present method further determines the difference between the total output power of the engine and the power requirements associated with all parasitic load components in operation and outputs a signal representative of this difference.

BRIEF DESCRIPTION OF THE DRAWINGS

For a better understanding of the present invention, reference may be made to the accompanying drawings in which.

DETAILED DESCRIPTION

Figure 1:
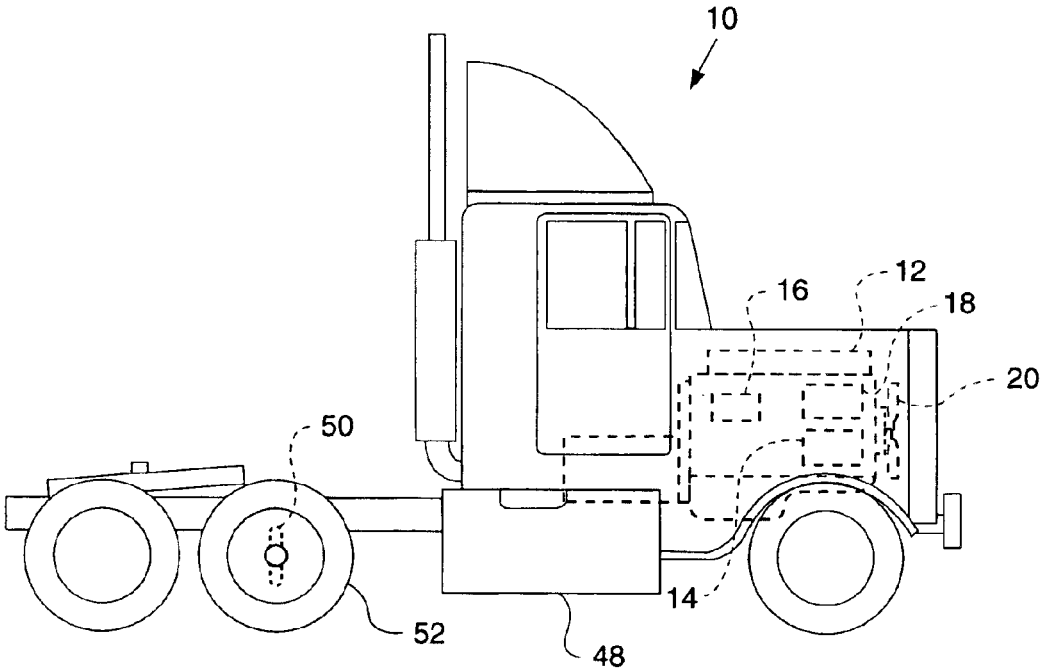
FIG. 1 is a simplified side elevational view of one embodiment of a truck chassis.

Referring to FIG. 1, numeral 10 in FIG. 1 represents a typical truck chassis having an engine 12 associated therewith including some typical peripheral devices or parasitic load components such as, for example, an air conditioning compressor 14, an alternator 16, a hydraulic pump 18, and a cooling fan 20. As illustrated in FIG. 1, the engine 12 associated with the particular truck chassis 10 is used to drive such vehicle as well as the other systems associated therewith including still other parasitic load components. In this regard, it is recognized that a typical vehicle manufacturer will collect and gather all of the necessary components associated with the construction and operation of a particular vehicle or work machine such as the chassis 10, engine 12, and parasitic load devices 14–20 illustrated in FIG. 1 and thereafter assemble the same onto the vehicle chassis during the construction and assembly process. It is also recognized and anticipated that the various parasitic load components will vary depending upon the particular vehicle or work machine involved. In a typical application there are some parasitic loads that can be engaged by the engine controller and others that are active when the engine is operating (such as power steering pumps, air compressors and the like). Once the engine and its associated parasitic load systems or components are married to the vehicle chassis, a calibration process is performed wherein each parasitic load component is engaged under predetermined engine operating conditions or is assumed to be active (in the case of these parasitic loads that are not capable of individual activation), and the parasitic loads or power requirements associated with each of those parasitic load components is determined and stored for future use as will be hereinafter explained. This calibration process is repeated under the various predetermined engine operating conditions and the amount of power required to operate each parasitic load under each of the various operating conditions tested is individually determined. This would include operating each parasitic load at a plurality of different engine speeds. A database of the parasitic load power requirement values thus obtained is then stored in the memory of the engine controller for future use.

Figure 2:
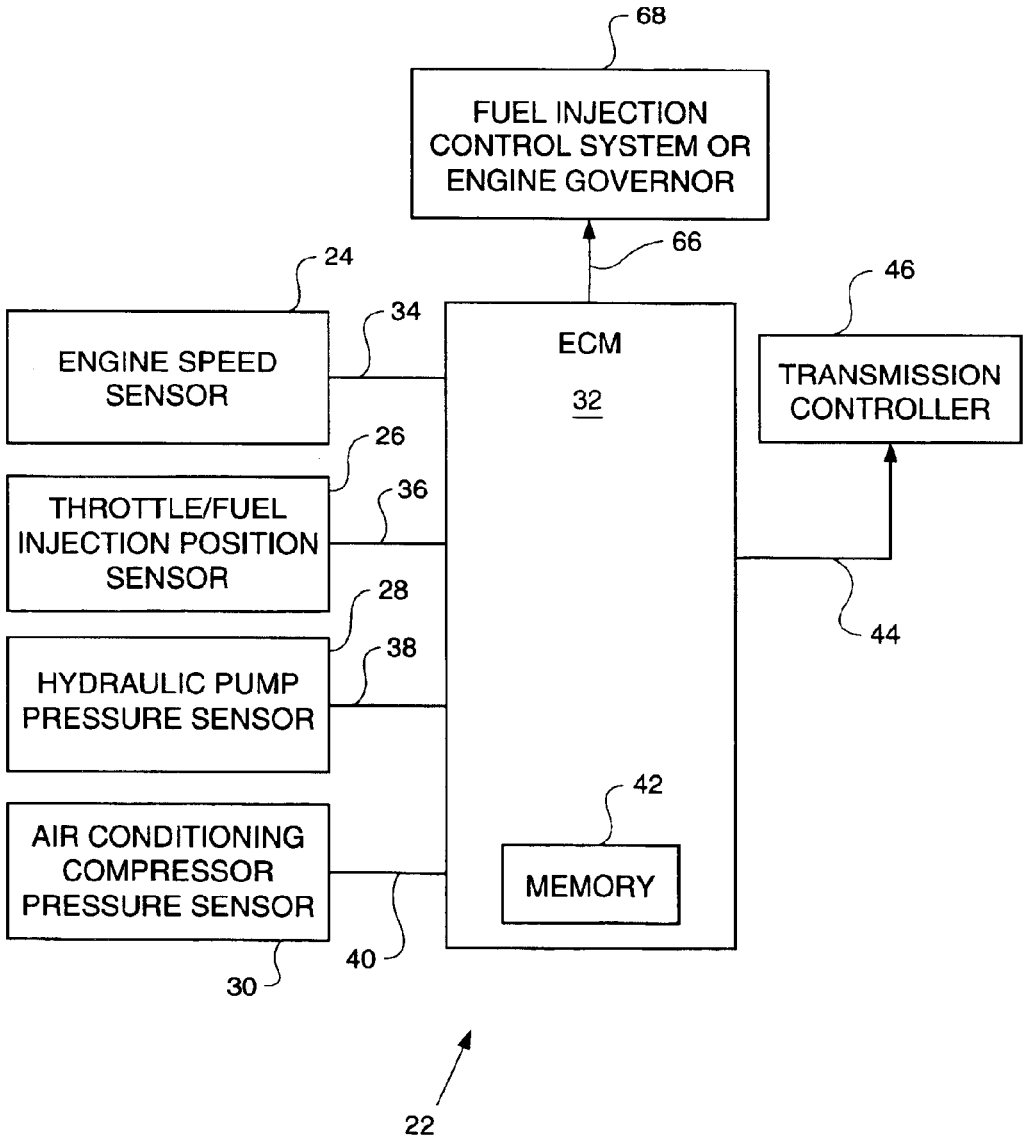
FIG. 2 is a schematic diagram of an engine control system constructed in accordance with the teachings of one embodiment of the present invention.

Number 22 in FIG. 2 represents one embodiment of an engine control system that incorporates the principles of the present invention. Because of the varying parasitic load configuration associated with any particular work machine or other vehicle, the engine control system 22 illustrated in FIG. 2 is merely representative of one of many systems incorporating the principals of the present invention and which can be utilized to more accurately determine the net power output of an engine during the operation thereof. As illustrated in FIG. 2, engine control system 22 includes an engine speed sensor 24, a throttle or fuel injection position sensor 26, a hydraulic pump pressure sensor 28 and an air conditioning compressor pressure sensor 30, all of which sensors provide input signals to an electronic control module (ECM) 32. Based upon the signals from sensors 24, 26, 28 and 30, ECM 32 will monitor and determine the net output power of engine 12 and provide appropriate output signals indicative thereof to various systems associated with the vehicle or work machine such as signals 44 and 66 to such systems as a fuel injection control system or engine governor system 68, or to a transmission controller 46 for reasons which will be hereinafter explained.

Electronic engine controllers or modules such as ECM 32 are commonly used in association with work machines and other vehicles for controlling and accomplishing various functions and tasks including monitoring and controlling engine functions such as engine speed, engine load and fuel flow to the respective cylinders and fuel injectors associated with a particular engine. ECM 32 may typically include processing means, such as a microcontroller or microprocessor, associated electronic circuitry such as input/output circuitry, analog circuits or programmed logic arrays, as well as associated memory such as the memory 42 illustrated in FIG. 2. It is known in the art to incorporate within ECM 32 appropriate driver circuitry for delivering current signals to the various valves and other devices associated with various systems on the vehicle or work machine.

An engine speed sensor 24 is coupled to ECM 32 via conductive path 34 for constantly delivering engine speed indicative signals to ECM 32 during the operation of the particular vehicle or work machine. The sensor 24 may be connected to the output shaft of a torque converter, or such sensor may be associated with the cam shaft of engine 12. Engine speed sensors or transducers are well known in the art and are commonly used to measure the engine output speed. Other suitable engine speed sensors such as Hall effect sensors, tachometers and the like may likewise be utilized without departing from the spirit and scope of the present invention.

A throttle/fuel injection position sensor 26 is also coupled to ECM 32 via conductive path 36 for constantly monitoring the engine throttle position and for delivering throttle/fuel injection position indicative signals to ECM 32 during the operation of the particular vehicle or work machine. Such throttle position/fuel injection type sensors are likewise well known in the art, a detailed description of such sensors is not included herein.

In similar fashion, pressure sensors 28 and 30 are likewise coupled to ECM 32 via conductive paths 38 and 40 for monitoring and sensing the pressure of the fluid within the particular system such as the output pressure from a particular hydraulic pump or the outlet pressure associated with a particular air conditioning compressor. Here again, such sensors are well known in the art and a detailed description is not included herein. As will be hereinafter explained, sensors 24 and 26 will be utilized by ECM 32 in order to determine the output power associated with the engine 12 whereas sensors 28 and 30 will be utilized during the calibration process to determine the particular parasitic load or power requirements associated with each parasitic load as well as during the operation of the particular work machine or other vehicle to determine the operation of the particular parasitic load during the operation of the engine.

Within the memory 42 of ECM 32 can be stored various lookup tables, torque converter speed correlation maps, algorithms, and other data which will correlate and/or determine the instantaneous power output of the engine 12 based upon input signals from sensors 24 and 26 as well as the calibration data associated with the operation of each parasitic load as will be hereinafter explained. These maps and calibration information will correlate the relationship between engine operating conditions and total engine output power and will yield net engine power output taking into account the power requirements associated with the operation of any one or more of the parasitic loads associated with a particular vehicle or work machine.

With the parasitic loads attached to the engine 12 and the chassis 10, and no other loads being driven, the engine 12 is operated and allowed to warm up to its operating temperature. The ECM 42 first calibrates the fuel delivery for parasitic loads that are normally active whenever the engine is operating. The ECM 42 preferably accomplishes this by determining the fuel command required to run the engine at predetermined engine speeds and then storing those values as the no-load fuel requirements. Those no-load fuel requirements may then be used to calculate fuel delivery commands when the engine is operating under a working load. Additionally, the ECM 42 may also calibrate power requirements for parasitic loads that can be turned on and off by the controller. To do this, the ECM 42 will preferably operate each parasitic load component while the engine is running at a predetermined engine speed or other predetermined operating condition and the sensors associated with such parasitic load such as sensors 28 and 30 will input signals to ECM 42 indicative of the power requirements associated with operating such parasitic loads at such predetermined engine operating condition. These data will then be stored within memory 42 and the calibration process will be repeated for the same parasitic load under varying operating conditions such as stepping the engine through a plurality of different engine speeds, for example, at increments of 100 rpm. All of this data will then be stored within memory 42 for use during actual vehicle or work machine operation.

With the engine operating, each of the various parasitic loads will be operated in turn to determine its individual power requirements in its on/off condition or, if a variable power requirement is associated with the particular parasitic load, as such parasitic load varies from its minimum to its maximum operating condition at each predetermined operating condition. For example, in the case of a constant speed cooling fan, the power requirements for the fan will be monitored and stored at each of its various operating speeds at each selected engine operating speed. In the case of a hydraulic pump which may operate at varying power requirements at a selected engine speed, the power requirements for that pump will be monitored and stored as a function of a particular operating condition, for example, the pressure output sensed by sensor 28, between its minimums and maximum load condition, at each selected engine speed. This data can then be used to correlate the sensed operating condition such as pump pressure to the power varying requirements of the parasitic load at each selected engine speed. These load requirements will then be stored or programmed into ECM 32 and sensors such as sensors 28 and 30 will input to ECM 32 the sensed operating condition permitting ECM 32 to know the power requirements in real time for the particular parasitic load being utilized. ECM 32 will then sum all of the parasitic loads in operation at a particular point in time and compare such parasitic load power requirements to the power requirements associated with sensors 24 and 26 to determine the net power output of the engine 12. This output signal, for example, would be indicative of total engine horsepower minus parasitic load horsepower so as to ensure that the remaining available horsepower is adequate to accomplish a particular work task such as performing a particular work task and/or controlling the operation of the engine and/or peripheral devices.

Once the above-described calibration process is completed and the values associated with the power requirements of the various parasitic loads are determined and stored in memory 42 of ECM 32, ECM 32, via appropriate sensors such as sensors 28 and 30, will determine which particular parasitic loads are operating during a particular operating condition of the vehicle or work machine, it will retrieve their corresponding power requirement values from memory 42 as described above, and it will add those values to determine the total parasitic load upon the engine 12 under that particular operating conditions. This determined parasitic load value can then be taken into account for more accurately determining both the amount of power being currently required from the engine 12 as well as the net power output of the engine available for performing work. These parasitic load values can be programmed into lookup tables, maps or other algorithms which then provide the proper power requirement relationship between inputs from appropriate sensors such as sensors 28 and 30 and the power usage associated with operation of the particular parasitic load at a particular engine operating condition. ECM 32 can then output or broadcast an appropriate signal indicative of the net power output of the engine available for doing work. This output signal such as signal 44 can then be utilized in controlling, for example, the operation of other systems associated with the particular vehicle or work machine such as the transmission controller 46 illustrated in FIG. 2 which determines when the transmission shifts from one gear to another gear to improve the overall operation of the engine 12 as will be hereinafter explained.

Referring again to FIG. 1, the truck chassis 10 likewise includes a transmission 48 which is coupled between engine 12 and a differential 50 for driving a pair of wheels 52 when operating a vehicle such as an over the road or off-road truck. It is desirable to control the operation of the transmission 48 such that shifts are made at the right rotational speed of the engine 12, which shifting strategy is determined by the available power output of the engine at a predetermined operating condition. The present control system 22 can be utilized to more accurately determine the proper shifting ranges of an automatic transmission such as the transmission 48 during normal operation by outputting signal 44 to an appropriate transmission controller 46 to accomplish this task. In this regard, ECM 32 can be further programmed with appropriate transmission operating characteristics which will indicate what power output range is needed in order to effect a shift from one gear to the next gear. This adequacy of power can be programmed for each successive pair of gears, or such relationship may be assumed to be uniform for each gear shift. Based upon this stored gear shift information and output signal 44 which is representative of the net power output of the engine 12, ECM 32 will output appropriate signals such as signal 44 to transmission control 46 to effect a gear shift change. In the case of controlling the shifting of an automatic transmission, signal 44 may be utilized to automatically control the shifting of transmission 48 when an adequate power output level is available as predetermined and preprogrammed into ECM 32. In the event that the particular work machine or other vehicle utilizes a manual transmission, output signal 44 could be utilized to provide an indication to the operator in the cab, such as by an audible and/or visual signal, that the transmission may be shifted manually to the next gear. Other variables affecting the shifting of the transmission may also be taken into account such as surface slope and the weight and load capacity of the work machine or other vehicle. Gear shift available power requirement information can be provided in appropriate maps, lookup tables and the like that could be stored in memory 42. Similarly, if ECM 32 is being used to control a particular vehicle or work machine so as to ensure adequacy of power output for powering the parasitic loads or performing a particular work task, similar programming can likewise be provided.

Figure 3:
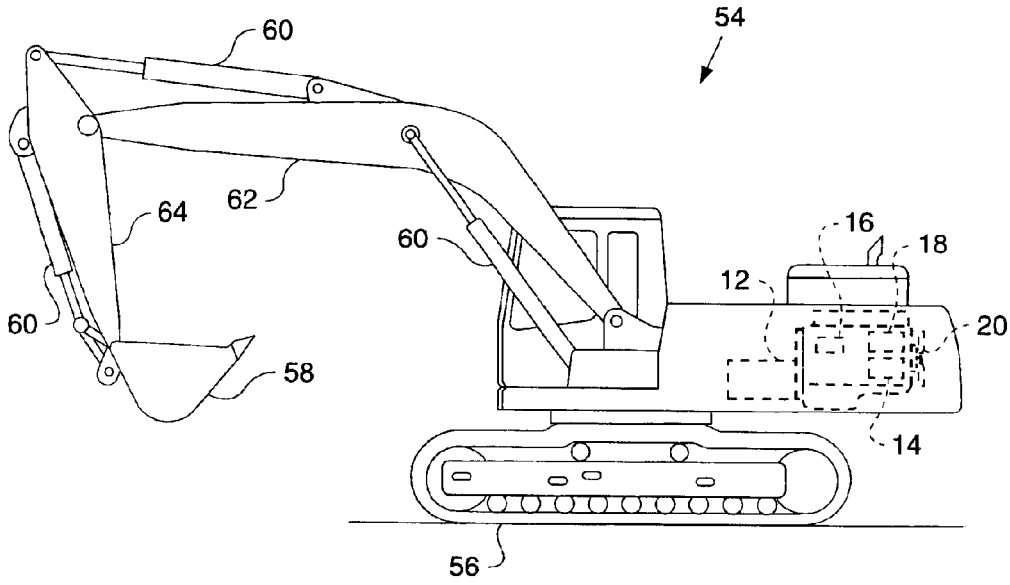
FIG. 3 is a simplified side elevational view of a work machine in the form of an excavator.

Although one embodiment of the present invention as discussed above is directed to using the output signal 44 from ECM 32 to provide a signal indicative of available power to indicate adequate power to control the operation of a transmission 48 associated with a particular vehicle 10, it is also contemplated that the present control system can likewise be utilized to control the operation of the engine 12 itself, or other systems associated with a particular vehicle or work machine. For example, FIG. 3 represents a tropical work machine 54 such as a track-type excavator having a pair of tracks 56, an engine 12 for providing motive power for moving the work machine 54 as well as for driving the various parasitic loads associated therewith such as an air conditioning compressor 14, an alternator 16, a hydraulic pump 18, and a cooling fan 20. The cooling fan can operate in a continuous mode, an on/off mode, or it can be a variable speed fan having a variable power requirement, all depending upon the cooling needs of the engine 12. Although other parasitic loads are associated with the work machine 54, the parasitic loads 14, 16, 18 and 20 are specifically identified for illustrative purposes only. During operation of the bucket 58, the hydraulic pump 18 is used to pressurize hydraulic fluid to operate the various components associated with the bucket 58 which typically includes a plurality of hydraulic cylinders 60, a boom 62 and a stick 64. Such constructions are well known in the art and need not be described in further detail herein. Once the work machine 54 is positioned at its desired location by having the engine 12 drive the tracks 56 in a known manner, the work machine 54 is stopped at the desired location and the transmission (not shown) is placed in neutral. The engine 12 is then allowed to continue to run so as to power the hydraulic pump 18 and the other parasitic loads associated therewith. Movement of the bucket 58 via the boom and stick members 62 and 64 to properly orient the same for a digging operation will require considerably less hydraulic pressure or power output from engine 12 as compared to when the bucket 58 is engaged with the earth and additional hydraulic pressure which translates into additional power output from the engine is required in order to commence the digging operation.

In the particular application identified above with respect to work machine 54, ECM 32 would receive input signals from sensors 24, 26, 28 and possibly 30 indicative of the total power output of the engine 12 as well as the power requirements associated with the parasitic loads represented by sensors 28 and 30. Based upon the calibration data stored in memory 42 representing the particular power requirements associated with the parasitic loads being sensed by sensors 28 and 30, a signal 44 is again generated and outputted by ECM 32 indicative of the difference between the total power output of engine 12 and the parasitic load power requirements, that is, the available remaining net power output of engine 12. In this particular scenario, ECM 32 can determine if this available power output is adequate according to preprogrammed criteria to power the parasitic loads in order to accomplish the particular work task. If the available power is not adequate, ECM 32 can affect an increase in power output of the engine 12 such as by outputting a signal 66 to an appropriate system such as a fuel injector control system or engine governor 68 until an adequate level of power is available. As the signals 38 and 40 from sensors 28 and 30 change indicating a change in the power requirements associated with such parasitic loads, ECM 32 will automatically and in real time process such signals and control the operation of engine 12 in order to ensure that the necessary power and other engine operating conditions are maintained in order to accomplish the particular work task. Although input signals 34, 36, 38 and 40 are received and processed preferably contemporaneously with the actual work operation, it is recognized and anticipated that delays may be built into the processing of the input signals as well as the generation of the new output signals if so desired, such as outputting signal 66 to the fuel injector control system or engine governor 68.

Calibration and programming of ECM 32 can be accomplished through the use of a remote device such as a service tool operated by a technician, or through the use of an on-board computer associated with the particular vehicle or work machine. It is also recognized and anticipated that ECM 32 may be a learning ECM which can be programmed to automatically update the power requirements of the various parasitic loads from time-to-time by either periodically re-running the calibration process for each parasitic load, either manually or automatically, or by automatically updating the calibration data stored in memory 42 during actual vehicle or work machine operation when individual parasitic loads can be isolated at particular engine operating conditions. In addition, if a parasitic load component is changed, for example, the hydraulic pump is replaced, ECM 32 would either manually or automatically generate new calibration data representative of the power requirements associated with the new parasitic load component as previously explained.

INDUSTRIAL APPLICABILITY

As described herein, the present engine control system has particular utility in a wide variety of different types of work machines, other equipment or vehicles and provides for improved operating efficiency and engine performance by compensating for the power requirements associated with the parasitic loads in operation during a particular work task. Parasitic loads are sensed during engine operation, the engine power requirements associated with each operating parasitic load are determined and subtracted from the total power output of the engine, and a signal indicative of the net output power of the engine is broadcasted or outputted for use in more efficiently controlling the operation of the engine as well as other systems associated with the work machine or other vehicle. The output signal generated indicates the remaining power output available by the engine for performing other tasks and/or for maintaining the operation of various parasitic loads and other systems. For example, in the case of a truck or other like vehicle, the adequacy of the remaining power output can be determined and correlated to the power needed to effect, for example, operation of peripheral equipment such as a transmission controller to control the proper shifting thereof. In the case of work machines such as earthmoving equipment, mining equipment and other heavy load capacity type equipment, it is desirable to more accurately determine the net power output of the engine over and above the operation of any parasitic loads since the engine is being utilized to perform certain work tasks such as controlling the operation of bucket 58 associated with work machine 54.

Input signals from sensors 24 and 26 are utilized by ECM 32 in a conventional manner for determining the total output power of the engine 12 and for controlling the operation thereof such as via output signal 66 to a fuel injection control system or an engine governor system 68. Output signals such as signal 66 to fuel control type systems are typically directed to various fuel emission valves, fuel injectors and other devices for controlling the delivery of fuel to the engine, which valves, fuel injectors and other devices are used in a conventional manner. In this regard, ECM 32 would deliver current control signals to such devices in a manner well known to a person skilled in the art.

Input signals from sensors associated with various parasitic loads such as sensors 28 and 30 are likewise utilized by ECM 32 in order to determine which parasitic loads are in operation and, if a variable load, based upon calibration data stored in memory 42, at what operating conditions the variable parasitic load is presently operating at. Based upon the calibration data stored in memory 42, ECM 32 can then determine the output power requirements associated with each operating parasitic load. All of the parasitic load requirements are then summed and thereafter subtracted from the total power output of the engine determined from, for example, input signals 34 and 36, so as to provide a signal that is representative of the total net power output of the engine. This output signal is processed to determine if the level of the difference between the total power output of the engine and the parasitic load requirements are adequate for the operation of the particular vehicle or work machine based upon the particular work task at hand. Appropriate maps, lookup tables, algorithms and the like can be stored in memory 42 or otherwise programmed into ECM 32 in order to measure, determine and compare the power output requirements of the engine and the various parasitic loads in accordance with the teachings of the present invention so as to give a more accurate indication of net engine output power. It is also recognized and anticipated that output signal 44 could be forwarded to some type of monitoring or display system wherein the net power output of the engine would be displayed in the operator cab for use by the operator in controlling the operation of the particular work machine or other vehicle.

Figure 4:
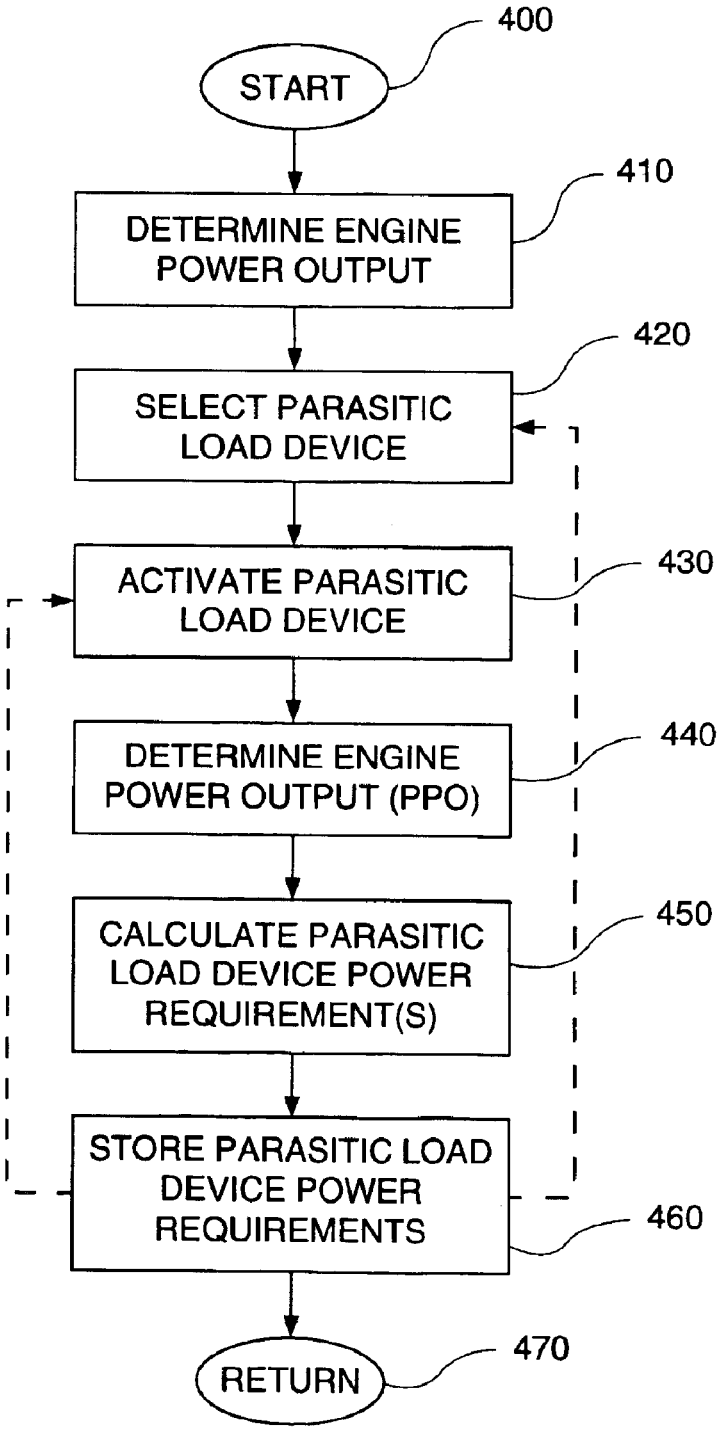
FIG. 4 is a flow chart of the operating steps for an engine control system constructed in accordance with the teachings of one embodiment of the present invention.
Figure 5:
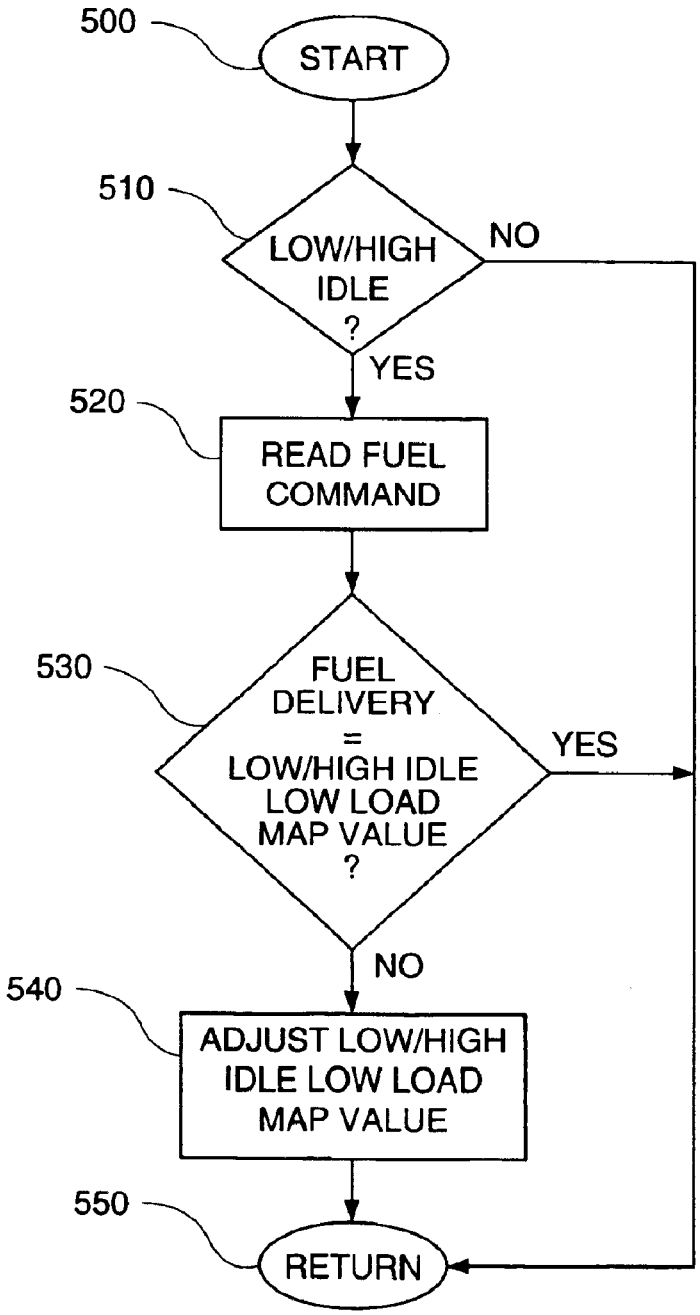
FIG. 5 is a flow chart of the operating steps for an engine control system constructed in accordance with the teachings of another embodiment of the present invention.

An example of alternative embodiments of calibration processes in which the engine ECM 32 measures and stores power level requirements of the various parasitic loads is shown in FIGS. 4 and 5.

Referring first to FIG. 4, one embodiment is shown. In block 400, program control begins and passes to block 410.

In block 410, the ECM 32 determines the current power output of the engine, preferably as a function of the amount of fuel being injected into the engine and the engine speed. This step preferably involves calibration of no-load fuel injection maps. As noted above, certain parasitic loads may be associated with the engine which cannot be individually turned on and off, and those loads may consume an amount of power that is different than expected. Thus, to account for those differences or for additional or different parasitic loads, a preferred embodiment of the present invention will first calibrate the engine fuel requirement under a no-load condition (i.e., when the engine is not performing any work other than driving the parasitic loads). These measured no-load fuel requirements may be different than those originally stored in memory of the ECM 42 when the engine was manufactured and are then used by the ECM 42 to modify, where appropriate, the actual no-load fuel requirements. In this manner, a preferable embodiment of the present invention will calibrate no-load fuel requirements taking into consideration parasitic loads that are associated with the engine and that cannot be turned on and off. Program control then passes to block 420.

In block 420 the ECM 32 selects one of the various parasitic load devices for operation. Program control then passes to block 430. In block 430 the ECM 32 activates the selected parasitic load device at a commanded level. Program control then passes to block 440.

In block 440, the ECM 32 determines the engine power output of the engine with the parasitic load device activated at the particular load level. Program control then passes to block 450.

In block 450, the ECM 32 calculates the parasitic load device power requirement at that operating level. Preferably, this calculation is made as a function of the engine power output of block 410 and the engine power output (PPO) of block 440. Program control then passes to block 460.

In block 460, the ECM 32 preferably stores the power required by the parasitic load device for that commanded level of activity in memory 42. Program control passes from block 460 and may return to block 420 in the case where a different parasitic load device is to be selected for calibration or to block 430 in the case where the same parasitic load device is to be calibrated at another activation level. Otherwise, program control passes to block 470 in the case where the calibration routine has finished and program control terminates and returns to the calling program.

In the manner depicted by the program of FIG. 4, an ECM 32 can determine and store the power requirements of one or a plurality of parasitic load devices and also determine the parasitic load device's power requirements at one or a plurality of different operating levels.

Referring now to FIG. 5, another embodiment of program control that may be used with an embodiment of the present invention is shown. Program control begins in block 500 and passes to block 510.

In block 510, the ECM 32 determines whether the engine is operating at one of a plurality of predetermined engine speeds which in a preferred embodiment is designated as High Idle or Low Idle condition. In a preferred embodiment, the ECM makes the determination of whether the engine is operating at High Idle or Low Idle as a function of the sensed engine speed being within a predetermined tolerance of a desired High Idle Speed or a desired Low Idle Speed, and the engine operating without external load. Typically the ECM 32 may determine that the engine is operating under no external load by monitoring the vehicle speed and determining whether any work implements (if any) are performing work. If the ECM 32 determines that the engine is not operating at a High Idle or a Low Idle condition then program control passes to block 550. Otherwise, if the ECM 32 determines that the engine is operating in a High Idle or Low Idle Condition, then program control passes to block 520.

In block 520, the ECM 32 determines the fuel command associated with causing the engine to operate at High Idle or Low Idle. Program control then passes to block 530.

In block 530, the ECM 32 preferably compares the fuel delivery command required for the engine to maintain the High/Low Idle Speed to a fuel command required to maintain that speed when there are no parasitic loads. Those skilled in the art will appreciate that if the actual fuel delivery command is greater than the no load value, the additional power (i.e., the amount of power generated by the incrementally greater amount of fuel) is the power required by the parasitic load devices. If the fuel command is equal to the corresponding fuel command stored in memory 42 for the High Idle Fuel Command or Low Idle Fuel Command (depending upon whether the engine state under evaluation is in a High Idle Condition or a Low Idle Condition) then program control passes to block 550, otherwise program control passes to block 540.

In block 540, the ECM 32 adjusts the value of the High Load Fuel Command or the Low Load Fuel Command, as the case may be, as a function of the actual Fuel delivery command. By storing the fuel delivery command as one of the High Load and/or Low Load Fuel Commands and subsequently using that value to calculate fuel commands under actual engine operating conditions, this embodiment of the present invention is able to measure the amount of power required by the parasitic load devices at the High and Low Idle operating points and can then calculate an approximate parasitic load requirement at other points in the engine operating range and use that calculation to make modifications to subsequent fuel delivery commands. Program control then passes from block 540 to block 550 and returns to the calling routine.

In an embodiment of the present invention, the ECM 32 will cause a program illustrated by the flowchart of FIG. 5 to be executed when the engine speed is within a predetermined tolerance of a selected High Idle Speed or Low Idle Speed and the ECM 32 determines that the engine is not operating an external load. In this manner, the ECM 32 automatically determines the parasitic load requirements while the equipment or vehicle is in operation. In alternative embodiments, a calibration mode may be used to force the engine to run at a High Idle Speed and a Low Idle Speed to thereby measure the fuel delivery requirement. Still other embodiments might use a manual mode to cause the engine to run at High Idle and Low Idle and record fuel delivery requirements.

It is also recognized that variations to the operating steps depicted in flow charts of FIG. 4 or 5 could be made without departing from the spirit and scope of the present invention. In particular, steps could be added or some steps could be eliminated and such inventions may nevertheless fall within the scope of the present invention.

It is also recognized and anticipated that the calibration process disclosed herein could be activated through the use of an internal or external device associated with the work machine or other vehicle such as through the use of an on-board computer, or such calibration process could be activated through the use of a service tool such as a laptop computer. In either scenario, the calibration process could be activated either manually or automatically on a periodic basis to update ECM 32 with the appropriate parasitic load power requirements. The calibration process could be stored within the on-board computer of the particular work machine or other vehicle, or such program could be stored within the laptop computer and such computer could interface with ECM 32 to activate and run the calibration process.

As is evident from the foregoing description, certain aspects of the present invention are not limited by the particular details of the examples illustrated herein and it is therefore contemplated that other modifications and applications, or equivalence thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A control system for determining the net power output of an engine associated with a work machine or other vehicle wherein the work machine or other vehicle includes an engine operable to provide power to at least two power-operated components, at least one of the power-operated components being a parasitic load component, said control system comprising:

an electronic controller coupled to the engine;

at least one sensor coupled to said controller for inputting at least one signal thereto representative of certain operating conditions of the engine;

said controller being operable to determine the total output power of the engine based upon said at least one sensor signal;

at least one other sensor coupled to said controller for inputting at least one signal thereto representative of the operation of the at least one parasitic load component;

said controller having memory associated therewith and having data stored therein relating to the power requirements of the at least one parasitic load component when said component is in operation at a plurality of engine speeds;

said controller being operable to determine the power requirements of the at least one parasitic load component based upon said at least one other sensor signal; and said controller being operable to provide an output signal representative of the difference between the total output power of the engine and the power requirements associated with the at least one parasitic load component.

2. The control system as set forth in claim 1 wherein at least one of said sensors coupled to said controller inputs a signal representative of engine speed.

3. The control system as defined in claim 1 wherein at least one of said sensors coupled to said controller inputs a signal representative of throttle position.

4. The control system as set forth in claim 1 wherein at least one of said sensors coupled to said controller inputs a signal representative of the amount of fuel being delivered to the engine.

5. The control system as set forth in claim 1 wherein at least one of said other sensors coupled to said controller inputs a signal representative of the fluid pressure associated with a hydraulic pump.

6. The control system as set forth in claim 1 wherein at least one of said other sensors coupled to said controller inputs a signal representative of the pressure associated with an air conditioning compressor.

7. The control system as set forth in claim 1 wherein the at least one parasitic load component operates at a substantially constant power requirement.

8. The control system as set forth in claim 1 wherein the at least one parasitic load component operates at varying power requirements.

9. The control system as set forth in claim 1 wherein the engine is operable to provide power to a plurality of parasitic load components, said controller memory having stored therein data relating to the power requirements of each of said parasitic load components when said components are in operation at a plurality of engine speeds.

10. The control system as set forth in claim 9 wherein at least one of the parasitic load components operates at a substantially constant power requirement and wherein at least one of the parasitic load components operates at a varying power requirement.

11. The control system as set forth in claim 9 wherein the data stored within the memory of said controller relating to the power requirements of a parasitic load component which operates at varying power requirements includes data relating to the operation of said parasitic load component at a plurality of different power requirements for each of said plurality of engine speeds.

12. The control system as set forth in claim 1 wherein the work machine or other vehicle includes a transmission controller, said controller being operable to output said output signal to said transmission controller to control the shifting of the transmission.

13. The control system as set forth in claim 12 wherein the transmission is an automatic transmission and said output signal is used to effect automatic shifting of the transmission in accordance with programmed instructions based upon the net power output of the engine.

14. The control system as set forth in claim 12 wherein the transmission is a manual transmission operable for shifting by an operator, said output signal being used to provide a shift signal to the operator to effect manual shifting of the transmission in accordance with programmed instructions based upon the net power output of the engine.

15. The control system as set forth in claim 1 wherein said output signal is used to control the operation of the engine.

16. A work machine or other vehicle comprising:

an engine having variable output power and operable to provide power to at least two power-operated components, at least one of said power-operated components being a parasitic load component;

a control system operable to control operation of at least a portion of the work machine or other vehicle in response to the power requirements of said at least two power-operated components, said control system including an electronic controller coupled to said engine and at least one sensor coupled to said electronic controller and operable to provide a signal indicative of at least one operating parameter of said engine;

said controller having memory associated therewith and having information stored therein correlating said at least one engine operating parameter to the total power output of said engine at a plurality of engine speeds and having additional information stored therein correlating the operation of said at least one parasitic load component to the power required for such operation at a plurality of engine speeds;

said controller being operable to determine the net power output of said engine by determining the difference between the total output power of the engine and the power requirement associated with said at least one parasitic load component, and to output a signal representative thereof to control operation of at least a portion of the work machine.

17. The work machine as set forth in claim 16 including a plurality of said at least one parasitic load components, information relating to the power requirements of each of said parasitic load components being stored within the memory of said controller.

18. The work machine as set forth in claim 17 wherein at least one of said parasitic load components operates at a substantially constant power requirement and wherein at least one of the parasitic load components operates at a varying power requirement.

19. The work device as set forth in claim 18 wherein the information stored within the memory of said controller relating to the power requirements of a parasitic load component operating at a substantially constant power requirement includes information correlating the power requirements of said parasitic load component at a plurality of engine speeds, and wherein the information stored within the memory of said controller relating to the power requirements of a parasitic load component operating at a varying power requirement includes information correlating a plurality of different power requirements for each of said plurality of engine speeds.

20. The work machine as set forth in claim 16 wherein said controller is further operable to output a signal representative of the power requirement of said at least one parasitic load component.

21. The work machine as set forth in claim 16 wherein said work machine includes a transmission, said output signal being operable to indicate when the power is adequate for effecting shifting of said transmission.

22. The work machine as set forth in claim 21 wherein said transmission is an automatic transmission and said output signal is used to effect automatic shifting of said transmission in accordance with predetermined criteria.

23. The work machine as set forth in claim 21 wherein said transmission is manually operable for shifting by an operator, said output signal being used to provide a shift signal to the operator to effect shifting of the transmission in accordance with predetermined criteria.

24. The work machine as set forth in claim 16 wherein said output signal is used to control the operation of the engine in accordance with predetermined criteria.

25. The work machine as set forth in claim 24 wherein said engine is controlled in response to said output signal to ensure adequate total power output of said engine.

26. A method of operating a power-operated work machine having a variable power output engine operable to drive a plurality of power-operated components at least one of which being a parasitic load component, the work machine having an electronic controller operably connected to the engine and operable to control operation of at least a portion of the work machine, said method comprising:

generating a first signal indicative of the total power output of the engine;

generating a second signal indicative of the power requirement of the at least one parasitic load component;

generating a third signal indicative of the difference between the total power output of the engine and the at least one parasitic load component power requirement; and utilizing the third signal for controlling operation of at least a portion of the work machine.

27. The method as set forth in claim 26 wherein the third signal is utilized to control shifting of a transmission operably connected to the engine.

28. The method as set forth in claim 26 including processing the third signal to determine if the difference between the total power output and parasitic load component power requirement is adequate for accomplishing a particular task and generating a fourth signal indicative of the adequacy of said power difference.

29. A method for determining the net power output of an engine associated with a work machine or other vehicle wherein the work machine or other vehicle includes an engine operable to provide power to at least two power-operated components, at least one of the power-operated components being a parasitic load component, the method comprising the steps of:

providing an electronic controller coupled to the engine;

sensing at least one engine parameter representative of the operating condition of the engine;

determining the total output power of the engine based upon said at least one sensed engine parameter;

sensing whether said at least one parasitic load component is in operation during operation of the engine;

determining the power requirement associated with the at least one parasitic load component when said component is in operation;

determining the difference between the total output power of the engine and the power requirement associated with the at least one parasitic load component; and outputting a signal representative of the difference between the total output power of the engine and the power requirement associated with the at least one parasitic load component.

30. The method as set forth in claim 29 wherein the step of determining the power requirement associated with the at least one parasitic load component when said component is in operation is accomplished through a calibration process, said calibration process including the steps of:

operating the engine with no parasitic load component in operation at a plurality of different engine operating conditions;

operating the engine and a selected one of the at least one parasitic load components at said plurality of different engine operating conditions;

comparing the operation of the engine with no parasitic load component in operation with the operation of the engine with the selected one parasitic load component in operation at each of said plurality of different operating conditions;

recording the effect of the operation of the selected one parasitic load component upon engine power at each of said plurality of different operating conditions;

storing the effect of the operation of the selected one parasitic load component upon engine power at each of said plurality of different engine operating conditions within the memory of said electronic controller; and correlating the effect of the operation of the selected one parasitic load component at each of said plurality of different engine operating conditions with a power requirement at each of said plurality of different engine operating conditions.

31. An internal combustion engine, installed in a vehicle being operably coupled to at least one parasitic load when in a no-load condition, comprising;

an electronic controller which includes a no load calibration algorithm that includes parasitic load requirement determination algorithm;

a fuel system operatively connected with said electronic controller and introducing fuel into cylinders of said internal combustion engine in response to fuel delivery at least one vehicle parameter sensor;

wherein said electronic controller determines that said engine running in a no load condition at least in response to a signal from said vehicle parameter sensor, and responsively stores a value representative of fuel delivered to the engine cylinder and a value representative of engine speed.

32. An internal combustion engine according to claim 31, wherein said fuel system includes a plurality of fuel injectors.

33. An internal combustion engine according to claim 31, wherein said vehicle parameter sensor includes at least one of: a transmission gear ration sensor; a vehicle speed sensor; a parking brake switch; and a neutral switch.

34. An internal combustion engine according to claim 33, wherein said engine controller determines that said engine is operating in a no load condition at least as a function of said vehicle speed signal indicative of the vehicle being stationary.

35. An internal combustion engine, installed in a vehicle, comprising:

an electronic controller;

a fuel system operatively connected with said electronic controller and introducing fuel into cylinders of said internal combustion engine in response to fuel delivery command signals produced by said electronic controller;

an engine speed sensor operatively connected with said electronic controller;

at least one vehicle parameter sensor;

wherein said electronic controller determines that said engine is running in a no load condition at least in response to a signal from said vehicle parameter sensor, and responsively stores a value representative of fuel delivered to the engine cylinders and a value representative of engine speed;

wherein said vehicle parameter sensor includes at least one of : a transmission gear ration sensor; a vehicle speed sensor; a parking brake switch; and a neutral switch;

wherein said engine controller determines that said engine is operating in a no load condition at least as a function of said vehicle speed signal indicative of the vehicle being stationary; and wherein said engine determines that said engine speed signal is within a predetermined tolerance of a value representative of a first predetermined engine speed for greater than predetermined time responsively stores a first no load fuel command value corresponding to said first predetermined engine speed.

36. An internal combustion engine according to claim 35, wherein said engine controller determines that said engine speed signal is within a predetermined tolerance of a value representative of a second predetermined engine speed for greater than a predetermined time and responsively stores a second no load fuel command value corresponding to said second engine speed.

37. An internal combustion engine according to claim 36, wherein said engine controller calculates no load fuel command values for engine speed other than said first and second predetermined engine speeds, said calculation being a function of said first and second no load fuel command values.

38. A method for controlling an internal combustion engine, comprising:

determing a no load fuel command at a predetermined engine speed when said engine is operating under no load condition that includes at least one parasitic load;

using said no load fuel command to develop fuel delivery signal when said engine is operating under a load that includes said at least one parasitic load.

39. A method according to claim 38, further comprising:

determing a second no load fuel command at a second predetermined engine speed when said engine is operating under no load condition that includes said at least one parasitic load;

calculating a no load fuel command for at least one engine speed other than said predetermined engine speed and said second predetermined engine speed, said calculating being a function of said no load fuel command and said second no load fuel command;

using said calculated no fuel command to determine a fuel delivery command when said engine is operating under a load that includes said at least one parasitic load and at said one other engine speed.

* * * * *

UNITED STATES PATENT AND TRADEMARK OFFICE

CERTIFICATE OF CORRECTION

PATENT NO. : 6,920,387 B1
DATED : July 19, 2005
INVENTOR(S) : James W. Landes et al.

It is certified that error appears in the above-identified patent and that said Letters Patent is hereby corrected as shown below:

Column 16,
Line 6, after "delivery" insert -- command signals produced by said electronic controller; an engine speed sensor operatively connected with said electronic controller; --.
Line 19, delete "ration" and insert -- ratio --.
Line 51, after "engine" insert -- controller --.
Line 54, after "than" insert -- a --.
Line 54, after "time" insert -- and --.

Column 18,
Line 8, after "no" insert -- load --.

Signed and Sealed this

Seventh Day of February, 2006

JON W. DUDAS
*Director of the United States Patent and Trademark Office*